United States Patent [19]

Brenk

[11] Patent Number: 4,608,131

[45] Date of Patent: Aug. 26, 1986

[54] PROCESS FOR THE ANODIC OXIDATION OF ALUMINUM AND USE THEREOF AS SUPPORT MATERIAL FOR OFFSET PRINTING PLATES

[75] Inventor: Michael Brenk, Wiesbaden, Fed. Rep. of Germany

[73] Assignee: Hoechst Aktiengesellschaft, Frankfurt Am Main, Fed. Rep. of Germany

[21] Appl. No.: 721,753

[22] Filed: Apr. 10, 1985

[30] Foreign Application Priority Data

Apr. 13, 1984 [DE] Fed. Rep. of Germany ..... 3413899

[51] Int. Cl.[4] ..... C25D 5/44

[52] U.S. Cl. ..... 204/33; 204/35.1; 204/38.3; 204/58; 204/129.1; 428/329; 428/339; 428/934; 430/278

[58] Field of Search ..... 204/33, 58, 27, 28, 204/35.1, 129.1, 38.3, 38.7; 430/278; 428/329, 339, 934

[56] References Cited

U.S. PATENT DOCUMENTS

| | | | |
|---|---|---|---|
| 3,511,661 | 5/1970 | Rauner et al. | 96/86 |
| 3,594,289 | 7/1971 | Watkinson et al. | 204/38.3 |
| 3,943,039 | 3/1976 | Wittrock | 204/58 |
| 4,110,147 | 8/1978 | Grunwald et al. | 204/38.3 |
| 4,211,619 | 7/1980 | Usbeck | 204/33 |
| 4,229,266 | 10/1980 | Usbeck | 204/33 |
| 4,277,555 | 7/1981 | Fromson et al. | 430/278 |
| 4,396,470 | 8/1983 | Atkinson | 204/38 A |
| 4,409,504 | 9/1977 | Chu et al. | 204/38 A |

FOREIGN PATENT DOCUMENTS

| | | | |
|---|---|---|---|
| 1495861 | 12/1977 | United Kingdom | 204/38 A |

*Primary Examiner*—Andrews R. L.

*Attorney, Agent, or Firm*—Schwartz, Jeffery, Schwaab, Mack, Blumenthal & Evans

[57] ABSTRACT

In the process for the anodic oxidation of mechanically, chemically and/or electrochemically roughened aluminum or of one of its alloys, an aqueous electrolyte, which is free from $H_2SO_4$ and contains $H_3PO_4$ and $Al^{+3}$ ions is used. The process parameters are: an electrolyte content of 25 g/l to 500 g/l of $H_3PO_4$ and at least 5 g/l of $Al^{+3}$ ions, a treatment time of 5 seconds to 500 seconds, a current density of 1 A/dm$^2$ to 30 A/dm$^2$ and a temperature of 35° C. to 95° C. The $Al^{+3}$ ion source in particular is a salt of aluminum having a phosphoroxo anion, such as $AlPO_4$. The material prepared in accordance with this invention is preferably employed as a support material for offset printing plates which carry a radiation-sensitive layer.

15 Claims, No Drawings

PROCESS FOR THE ANODIC OXIDATION OF ALUMINUM AND USE THEREOF AS SUPPORT MATERIAL FOR OFFSET PRINTING PLATES

BACKGROUND OF THE INVENTION

The present invention relates to a process for the anodic oxidation of aluminum which is in particular employed as a support material for offset printing plates, the process being performed using an aqueous electrolyte on a basis of phosphoric acid.

Support materials for offset printing plates are provided, on one or both sides, with a radiation-(photo-)sensitive layer (reproduction layer), either directly by the user or by the manufacturers of precoated printing plates. This layer permits the production of a printing image of an original by photochemical means. Following the production of this printing form from the printing plate, the layer support carries the image areas which accept ink in the subsequent printing process and, simultaneously, there is formed, in the areas which are free from an image (non-image areas) in the subsequent printing process, the hydrophilic image background for the lithographic printing operation.

For the above reasons, the following requirements are demanded of a layer support for reproduction layers used in the manufacture of offset printing plates:

Those portions of the radiation-sensitive layer which have become comparatively more soluble following exposure must be capable of being easily removed from the support by a developing operation, in order to produce the hydrophilic non-image areas without leaving a residue, and without the developer substantially attacking the support material.

The support, which has been laid bare in the non-image areas, must possess a high affinity for water, i.e., it must be strongly hydrophilic, in order to accept water rapidly and permanently during the lithographic printing operation, and to exert an adequate repelling effect with respect to the greasy printing ink.

The radiation-sensitive layer must exhibit an adequate degree of adhesion prior to irradiation (exposure), and those portions of the layer which print must exhibit adequate adhesion following irradiation.

The support material should possess high mechanical strength, e.g., with respect to abrasion, and good chemical resistance to the action of materials such as alkaline media.

The base material employed for layer supports of this type in particular is aluminum. It is superficially roughened by means of known methods, such as dry brushing, wet brushing, sandblasting, chemical and/or electrochemical treatment. Especially the electrochemically roughened substrates are then subjected to an anodizing treatment, during which a thin oxide layer is built up, in order to improve the abrasion resistance. These anodic oxidation processes are usually performed in electrolytes such as $H_2SO_4$, $H_3PO_4$, $H_2C_2O_4$, $H_3BO_3$, amidosulfonic acid, sulfosuccinic acid, sulfosalicylic acid or mixtures thereof. The oxide layers built up in these electrolytes or electrolyte mixtures are distinguished from one another by their structures, layer thicknesses and resistance to chemicals. Aqueous solutions of $H_2SO_4$ or $H_3PO_4$ are predominantly employed in the industrial production of offset printing plates. As far as electrolytes containing $H_2SO_4$ are concerned, reference is made, for example, to U.S. Pat. No. 4,211,619 and to the prior art publications mentioned therein.

Aluminum layers produced in aqueous electrolytes containing $H_2SO_4$ are amorphous and, in the case of offset printing plates, in general have a weight of about 0.5 to 10 g/m$^2$, which corresponds to a layer thickness of about 0.15 to 3.0 μm. When a support material anodically oxidized in this way is used for offset printing plates, a disadvantage is presented by the relatively low resistance of oxide layers produced in $H_2SO_4$ electrolytes to alkaline solutions. Solutions of this type are employed, to an increasing extent, for example, in the processing of presensitized offset printing plates, preferably in to-date developer solutions for irradiated negative-working or, in particular, positive-working radiation-sensitive layers. Furthermore, these aluminum oxide layers often tend to a more or less irreversible adsorption of substances from the applied reproduction layers, which may, for example, lead to a coloration of the oxide layers, i.e., "staining".

It is also known to perform the anodic oxidation of aluminum in aqueous electrolytes which contain oxygen-containing phosphoric acids and optionally, additional compounds. Processes of this kind are, for example, disclosed in:

U.S. Pat. No. 3,511,661, which describes the use of 42 to 85% strength aqueous $H_3PO_4$ solutions at a temperature of at least 17° C. and a current density of about 1.5 to 3 A/dm$^2$ (direct current), in the production of support materials for printing plates;

U.S. Pat. No. 3,594,289, which describes the use of 5 to 50% strength aqueous solutions of $H_3PO_4$ at a temperature of 15° to 40° C. and a current density of 0.5 to 2 A/dm$^2$ (d.c. or a.c.) for the production of printing plates provided with a reproduction layer that contains a photopolymerizable compound;

German Offenlegungsschrift No. 25 07 386 (British Pat. No. 1,495,861), which describes the use of 1 to 20% strength aqueous solutions of $H_3PO_4$ or of polyphosphoric acid, at a temperature of 10° to 40° C., a current density of 1 to 5 A/dm$^2$ (a.c.) and a voltage of 1 to 50 V, for the production of support materials for printing plates;

U.S. Pat. No. 4,049,504, which describes the use of an aqueous electrolyte with a content of 1 to 3 parts of $H_2SO_4$ and of 3 to 1 parts of $H_3PO_4$ (total concentration 15 to 25%), at a temperature of 25° to 50° C., a treatment time of 0.25 to 3 minutes and a current density of 1 to 16 A/dm$^2$ (d.c. or a.c.), for the production of support materials for printing plates;

U.S. Pat. No. 4,229,266, which describes the use of an aqueous electrolyte containing 25 g/l to 150 g/l of $H_2SO_4$, 10 g/l to 50 g/l of $H_3PO_4$ and 5 g/l to 25 g/l of $Al^{+3}$ ions (for example, in the form of $Al_2(SO_4)_3.18H_2O$), at a current density of 4 to 25 A/dm$^2$ and at a temperature of 25° to 65° C., especially for the production of support materials for printing plates; and U.S. Pat. No. 4,396,470, which describes the use of an aqueous electrolyte containing from 328 g/l to 380 g/l of $H_3PO_4$ in a first anodizing step and the use of another aqueous electrolyte containing from 20 g/l to 150 g/l of $H_2SO_4$ and from 250 g/l to 380 g/l of $H_3PO_4$ in a second anodizing step, the process parameters including a treatment time for each step of 0.25 min to 4.0 min, a voltage of 15 V to 35 V and a temperature of 15° C. to 46° C.

It is true that the known oxide layers produced in $H_3PO_4$ electrolytes often show a greater resistance to alkaline media than oxide layers produced in an electrolyte based on a $H_2SO_4$ solution, and that they also present some other advantages, such as brighter surfaces, a better ink-water balance or low dye-stuff adsorption ("staining" in the non-image areas), but they also have some significant disadvantages. In to-date web-processing installations, there can, for example, be achieved oxide layers having weights of not more than about 1.0 $g/m^2$, the maximum weights being about 1.5 $g/m^2$, with voltages and bath dwell times commonly employed in industrial practice. It is obvious that layers of such low thicknesses provide a less effective protection against mechanical abrasion than thicker oxide layers prepared in $H_2SO_4$ electrolytes. Due to the greater pore volume and pore diameter of an oxide layer built up in a $H_3PO_4$ solution, the mechanical stability of the oxide layer itself is reduced, too, which leads to a further decrease of the abrasion resistance. In the case of certain negative-working layers, adhesion problems may also arise so that it is not possible to make universal use of known support materials for printing plates.

By means of the known two-stage oxidation processes, support materials for offset printing plates can be produced which, in respect of practical requirements, exhibit acceptable or even good properties and which also possess a resistance to alkali that substantially comes up to the resistance of an oxide layer produced in an aqueous electrolyte containing $H_3PO_4$. These processes, however, necessitate an increased apparatus expenditure, since the anodic oxidation must be performed in two baths, often with an additional intermediate rinsing bath. Such an installation requires supplementary aggregates and control means, which produce, inter alia, further possible sources of error. If $H_3PO_4$ is used as the electrolyte in the first state, there is also the danger of "burns" in and on the oxide layer, which lead to pinholes which, especially in the field of lithography, are very undesirable. There have also been disclosed mixed electrolytes with a constant of $H_3PO_4$ and at least one further component, in particular an aqueous mixed electrolyte with a content of $H_2SO_4$, $H_3PO_4$ and $Al^{+3}$ ions, but this electrolyte, too, results in oxide layers exhibiting a low resistance to alkaline media, which will be demonstrated by the comparative examples below.

SUMMARY OF THE INVENTION

It is therefore an object of this invention to provide a process for the anodic oxidation of roughened, sheet-like aluminum. Another object of the invention is to provide a process for producing oxidized aluminum which is particularly suitable as a support material for offset printing plates. Still another object of the invention is to provide a process, as above, which can be performed in a modern web processing unit without much expenditure of equipment and process engineering. Yet another object of the invention is to provide a process for producing support materials distinguished by an improved resistance to alkaline media and excellent mechanical stability.

In particular, these and other objects of the invention are achieved by a process for anodic oxidation of material selected from aluminum and aluminum alloys which comprises the steps of roughening the surface of the material by mechanical, chemical or electrochemical means; placing the material in an aqueous electrolyte free from $H_2SO_4$ and containing from about 25 to about 500 grams per liter of $H_3PO_4$ and at least 5 grams per liter of $Al^{+3}$ ions, said electrolyte being maintained at a temperature of from about 35° C. to about 95° C.; and anodically oxidizing the material at a current density of from about 1 $A/dm^2$ to about 30 $A/dm^2$ for a period of from about 5 to about 500 seconds, forming thereby an aluminum oxide layer on the surface of said material.

The objects of the invention are further achieved by a support material for offset printing plates which comprises a substrate of aluminum or aluminum alloy having an aluminum oxide layer produced by anodic oxidation in an electrolyte containing $H_3PO_4$ and $Al^{+3}$ ions, and a photosensitive layer coated over the aluminum oxide layer, wherein the photosensitive layer, after exposure, yields a surface in imagewise configuration useful in printing.

DESCRIPTION OF THE PREFERRED EMBODIMENTS

The invention is based on a process for the anodic oxidation of plate-, sheet-, or web-shaped materials of mechanically, chemically and/or electrochemically roughened aluminum or one of its alloys, in an aqueous electrolyte containing $H_3PO_4$ and $Al^{+3}$ ions. In the process according to the invention, the anodic oxidation of the materials is performed in an aqueous electrolyte which is free from $H_2SO_4$ and contains 25 g/l to 500 g/l of $H_3PO_4$ and at least 5 g/l of $Al^{+3}$ ions, during a period of 5 seconds to 500 seconds, and at a current density of 1 $A/dm^2$ to 30 $A/dm^2$ and a temperature of 35° to 95° C. In a preferred embodiment, these values are: 50 g/l to 150 g/l of $H_3PO_4$, 10 g/l to 20 g/l of $Al^{+3}$ ions, 10 s to 300 s, 2 $A/dm^2$ to 20 $A/dm^2$ and 40° C. to 75° C. In particular, the concentration of the aqueous electrolyte is adjusted such that it contains 5 to 15 parts by weight of $H_3PO_4$ per 1 part by weight of $Al^{+3}$ ions.

As the $Al^{+3}$ ion source, the aqueous electrolyte preferably contains a salt of aluminum with a phosphoroxo anion, in particular an aluminum salt of orthophosphoric acid ($H_3PO_4$). The maximum concentration of $Al^{+3}$ ions is determined by the saturation of the respective aqueous electrolyte with aluminum salt. The ranges of concentration of the electrolyte components are checked at regular intervals, for they are decisive for an optimum process run. The electrolyte is then regenerated discontinuously or continuously. The process of the invention can be carried out discontinuously or, preferably, continuously. In the practical performance of the process, preference is given to good circulation of the electrolyte, which can be achieved by agitating or by means of a recirculating pump. In continuous processes care has to be taken that the electrolyte is conveyed, as far as possible, in a direction parallel to the web to be treated, and that a turbulent electrolyte flow at high speed is produced, whereby a good transport of material and heat is ensured. The rate of flow of the electrolyte, relative to the aluminum web, appropriately exceeds 0.3 m/s. The type of current used is preferably direct current, but it is also possible to use alternating current or a combination of these kinds of current (for example, direct current with a super-imposed alternating current). The voltages in general vary between 20 V and 100 V.

When the aluminum salt concentration and voltage are increased, the oxide layer weight, which can be achieved employing the process of this invention, is increased too. Whereas at concentrations of less than 5 g/l of $Al^{+3}$ ions, at voltages of up to 30 V and anodizing times of up to 150 seconds, oxide layer weights of up to about 0.8 $g/m^2$ can be realized, layer weights of more than 3 $g/m^2$ can surprisingly be produced at higher $Al^{+3}$ ion concentrations, even at temperatures above 40° C. The highest oxide layer growth which can be achieved by means of the above-mentioned phosphoroxo anions is usually stated when $AlPO_4$ is employed. It has been surprising to note that the oxide layer weights and thicknesses achieved are within the range of an oxide layer produced in an electrolyte containing $H_2SO_4$. The resistance of the oxide layer to mechanical abrasion increases with the increasing oxide layer weight. The correction contrast (appearance of light areas on a stained background following corrections) and "staining" are almost independent of the $Al^{+3}$ ion concentration. With increasing anodizing times at constant oxide layer weights, improved values of mechanical abrasion resistance are usually observed.

The oxide layers produced according to this invention combine the advantages known from supports which have been anodically oxidized in phosphoric acid, such as a bright color, very good resistance to alkali and low tendency to staining, with the advantage of supports which have been anodically oxidized in sulphuric acid, namely a high oxide layer weight and, as a result thereof, good resistance to mechanical abrasion.

Suitable base materials for the material to be oxidized in accordance with this invention include aluminum or one of its alloys which, for example, have an Al content of more than 98.5% by weight and additionally contain amounts of Si, Fe, Ti, Cu and Zn. These aluminum support materials are first roughened, optionally after a precleaning step, by mechanical (e.g., brushing and/or treatment with an abrasive agent) and electrochemical (e.g., a.c. treatment in aqueous HCl, $HNO_3$ or salt solutions) means or by electrochemical means only. All process steps can be carried out discontinuously, but preferably they are performed continuously.

In continuous processes, in particular, the process parameters in the electrochemical roughening step are normally within the following ranges: temperature of the electrolyte 20° C. to 60° C., concentration of active substances (acid, salt) between 2 g/l and 100 g/l (in the case of salts even higher), current density 15 to 250 $A/dm^2$, dwell time of a material spot to be roughened in the electrolyte 3 to 100 seconds, and rate of flow of the electrolyte on the surface of the material to be roughened 5 to 100 cm/s. The type of current used usually is alternating current, but it is also possible to use modified current types, such as alternating current having different current intensity amplitudes to the anodic and for the cathodic current. The average peak-to-valley height $R_z$ of the roughened surface is in a range from about 1 to 15 $\mu$m. The peak-to-valley height is determined according to DIN 4768, October 1970 version, the peak-to-valley height $R_z$ then being the arithmetic mean of the individual peak-to-valley heights of five mutually adjoining individual measuring sections.

Precleaning includes, for example, treatment with an aqueous NaOH solution with or without a degreasing agent and/or complex formers, trichloroethylene, acetone, methanol or other commercially available substances known as aluminum treatment agents. Following roughening or, in the case of several roughening steps, between the individual steps, it is possible to perform an additional etching treatment, during which in particular a maximum amount of 2 $g/m^2$ is removed (between the individual steps, up to 5 $g/m^2$). Etching solutions in general are aqueous alkali metal hydroxide solutions or aqueous solutions of salts showing alkaline reactions or aqueous solutions of acids on a basis of $HNO_3$, $H_2SO_4$ or $H_3PO_4$, respectively. Apart from an etching treatment step performed between the roughening step and a subsequent anodizing step, there are also known non-electrochemical treatments which have substantially a purely rinsing and/or cleaning effect and are, for example, employed to remove deposits which have formed during roughening, i.e., "smut", or simply to remove electrolyte remainders. Dilute aqueous alkali metal hydroxide solutions or water can, for example, be used for these treatments.

The step of an anodic oxidation of the aluminum support material for printing plates is optionally followed by one or several post-treating steps. In particular when the process of this invention is employed, these post-treating steps are often not required. Post-treating particularly means a hydrophilizing chemical or electrochemical treatment of the aluminum oxide layer, for example, an immersion treatment of the material in an aqueous solution of polyvinyl phosphonic acid according to German Pat. No. 16 21 478 (British Published Application No. 1,230,447), an immersion treatment in an aqueous solution of an alkali-metal silicate according to U.S. Pat. No. 3,181,461, or an electrochemical treatment (anodic oxidation) in an aqueous solution of an alkali metal silicate according to U.S. Pat. No. 3,902,976. These post-treatment steps serve, in particular, to improve even further the hydrophilic properties of the aluminum oxide layer, which are already sufficient for many fields of application, with the other well-known properties of the layer being at least maintained.

The materials prepared in accordance with this invention are preferably used as supports for offset printing plates, i.e., one or both surfaces of the support material are coated with a photosensitive composition, either by the manufacturers of presensitized printing plates or directly by the users. Suitable radiation-(photo-)sensitive layers basically include all layers which after irradiation (exposure), optionally followed by development and/or fixing, yield a surface in imagewise configuration which can be used for printing.

Apart from the silver halide-containing layers used for many applications, various other layers are known which are, for example, described in "Light-Sensitive Systems" by Jaromir Kosar, published by John Wiley & Sons, New York; 1965: colloid layers containing chromates and dichromates (Kosar, Chapter 2); layers containing unsaturated compounds, which upon exposure, are isomerized, rearranged, cyclized, or crosslinked (Kosar, Chapter 4); layers containing compounds which can be photopolymerized, in which, on being exposed, monomers or prepolymers undergo polymerization, optionally with the aid of an initiator (Kosar, Chapter 5); and layers containing o-diazoquinones, such as naphthoquinone-diazides, p-diazoquinones, or condensation products of diazonium salts (Kosar, Chapter 7).

The layers which are suitable also include the electrophotographic layers, i.e., layers which contain an inorganic or organic photoconductor. In addition to the photosensitive substances, these layers can, of course, also contain other constituents, such as for example, resins, dyes or plasticizers. In particular, the following photosensitive compositions or compounds can be employed in the coating of the support materials prepared in accordance with this invention:

positive-working reproduction layers which contain o-quinone diazides, preferably o-naphthoquinone diazides, such as high or low molecular-weight naphthoquinone-1,2-diazide-2 sulfonic acid esters or amides as the light-sensitive compounds, which are described, for example, in German Pat. Nos. 854,890; 865,109; 879,203; 894,959; 938,233; 1,109,521; 1,144,705; 1,118,606; 1,120,273; 1,124,817, and 2,331,377 and in European Patent Application No. 0,021,428 and No. 0,055,814;

negative-working reproduction layers which contain condensation products from aromatic diazonium salts and compounds with active carbonyl groups, preferably condensation products formed from diphenylamine-diazonium salts and formaldehyde, which are described, for example, in German Pat. Nos. 596,731; 1,138,399; 1,138,400; 1,138,401; 1,142,871 and 1,154,123; U.S. Pat. Nos. 2,679,498 and 3,050,502 and British Published Application No. 712,606;

negative-working reproduction layers which contain co-condensation products of aromatic diazonium compounds, such as are, for example, described in German Pat. No. 20 65 732, which comprise products possessing at least one unit each of (a) an aromatic diazonium salt compound which is able to participate in a condensation reaction and (b) a compound which is able to participate in a condensation reaction, such as a phenol ether or an aromatic thioether, which are connected by a divalent linking member derived from a carbonyl compound capable of participating in a condensation reaction, such as a methylene group;

positive-working layers according to German Offenlegungsschrift No. 26 10 842, German Pat. No. 27 18 254 or German Offenlegungsschrift No. 29 28 636, which contain a compound which, on being irradiated, splits off an acid, a monomeric or polymeric compound which possesses at least one C—O—C group which can be split off by acid (e.g., an orthocarboxylic acid ester group or a carboxylic acid amide acetal group), and, if appropriate, a binder;

negative-working layers, composed of photopolymerizable monomers, photo-initiators, binders and, if appropriate, further additives. In these layers, for example, acrylic and methacrylic acid esters, or reaction products of diisocyanates with partial esters of polyhydric alcohols are employed as monomers, as described, for example, in U.S. Pat. Nos. 2,760,863 and 3,060,023, and in German Offenlegungsschrift No. 20 64 079 and No. 23 61 041;

negative-working layers according to German Offenlegungsschrift No. 30 36 077, which contain, as the photo-sensitive compound, a diazonium salt polycondensation product or an organic azido compound, and, as the binder, a high-molecular weight polymer with alkenyl-sulfonylurethane or cycloalkenyl-sulfonylurethane side groups.

It is also possible to apply photo-semiconducting layers to the support materials prepared in accordance with this invention, such as described, for example, in German Pat. Nos. 1,117,391, 1,522,497, 1,572,312, 2,322,046, and 2,322,047, as a result of which highly photosensitive electrophotographic printing plates are obtained.

From the coated offset printing plates prepared using the support materials produced in accordance with the present invention, the desired printing forms are obtained in known manner by imagewise exposure or irradiation, followed by washing out the non-image areas by means of a developer, for example, an aqueous-alkaline developer solution.

The single-stage process according to the present invention combines, inter alia, the following advantages:

Even without a hydrophilizing post-treatment the non-image areas of printing plates are free from "staining" after development. This shows that the oxide surface produced in accordance with this invention is clearly superior to an oxide layer of a comparable weight, which has been produced in an electrolyte containing $H_2SO_4$ or a mixture of $H_2SO_4$ and $H_3PO_4$.

The resistance to alkali of the oxide obtained is superior to the resistance to alkali of an oxide produced in an aqueous electrolyte containing $H_2SO_4$ or a mixture of $H_2SO_4$ and $H_3PO_4$.

The oxide layer weights which can be achieved correspond to the oxide layer weights which can be achieved using a $H_2SO_4$-containing electrolyte, and thus, in respect of layer thicknesses, are clearly superior to the oxides produced in a $H_3PO_4$-containing electrolyte.

The oxide layers exhibit good hydrophilic properties, so that the hydrophilizing post-treatment steps known from the art of printing plate production can optionally be dispensed with.

The support materials are suitable for universal use as supports for positive-working, negative-working and electrophotographic reproduction layers.

In the preceding description and in the Examples which follow, percentages denote percent by weight, unless otherwise specified. Parts by weight (p.b.w.) are related to parts by volume (p.b.v.) as grams are related to $cm^3$. In the Examples, the methods described below were employed to test the surface properties. The results of these tests are compiled in the respective tables:

Zincate test (according to U.S. Pat. No. 3,940,321, column 3, lines 29 to 68 and column 4, lines 1 to 8):

The rate of dissolution, in seconds, of an aluminum oxide layer in an alkaline zincate solution is a measure of the *resistance to alkali* of the layer. The longer the time required by the layer to dissolve, the higher is its resistance to alkali. The thicknesses of the layers should be approximately comparable, because they are, of course, also a parameter of the rate of dissolution. A drop of a solution composed of 500 ml of distilled water, 480 g of KOH, and 80 g of zinc oxide is applied to the surface to be tested, and the time taken for the metallic zinc to appear is measured, which is shown by a black staining of the area tested.

Determination of the *weight per unit area* of an aluminum oxide layer by chemical dissolution (according to DIN 50944, March 1969 edition):

A solution composed of 37 ml of $H_3PO_4$ (density 1.71 g/ml at 20° C., corresponding to 85% strength $H_3PO_4$), 20 g of $CrO_3$, and 963 ml of distilled $H_2O$ is used to dissolve the aluminum oxide layer from the base metal, at a temperature of from 90° to 95° C., during 5 minutes. The resulting loss of weight is determined by weighing the sample prior to and after dissolving the layer. The loss of weight and the weight of the surface covered by the layer are then taken to calculate the weight per unit area of the layer, which is given in $g/m^2$.

To test the *abrasion,* an abrasion wheel is moved over the surface of an uncoated plate sample, and the loss of weight of the surface, per unit area (relative to a standard treatment time), is determined.

COMPARATIVE EXAMPLES C1 TO C8

A bright-rolled aluminum sheet having a thickness of 0.3 mm was degreased by means of an aqueousalkaline etching solution, at a temperature of 50° C. to 70° C. Electrochemical roughening of the aluminum surface was performed in an electrolyte containing HCl, using alternating current. Subsequently, the aluminum surface was anodically oxidized by means of an aqueous electrolyte containing 150 g/l of $H_3PO_4$. In Table 1, the process parameters and the results of the measurements of the surface properties are compiled. The anodic oxidation was performed using direct current having a voltage of from about 35 V to 45 V.

TABLE 1

| Example No. | Process parameters: current density ($A/dm^2$) | Temperature (°C.) | Treatment time (sec) | Surface properties: Weight per unit area ($g/m^2$) | Abrasion ($g/m^2$) | Resistance to alkali (sec) |
|---|---|---|---|---|---|---|
| C1 | 1 | 30 | 200 | 0.34 | 0.77 | 110 |
| C2 | 1 | 30 | 500 | 0.54 | 0.80 | 125 |
| C3 | 3 | 30 | 60 | 0.60 | 0.69 | 115 |
| C4 | 3 | 30 | 150 | 0.88 | 0.80 | 105 |
| C5 | 1 | 60 | 200 | 0.14 | 1.00 | 95 |
| C6 | 1 | 60 | 500 | 0.14 | 1.10 | 85 |
| C7 | 3 | 60 | 60 | 0.14 | 1.13 | 100 |
| C8 | 3 | 60 | 150 | 0.14 | 0.98 | 110 |

If an amount of aluminum salts that results in $Al^{+3}$ ion concentration of less than 5 g/l was added to this aqueous electrolyte, the process parameters concerning the surface properties, in particular the weight per unit area, were within a range corresponding to the properties of the electrolyte without an $Al^{+3}$ ion admixture.

EXAMPLES 1 TO 9

The process was the same as in Comparative Examples C1 to C8, except that an aqueous electrolyte containing 100 g/l of $H_3PO_4$ and 15 g/l of $Al^{+3}$ ions (corresponding to 68 g/l of $AlPO_4$) was used. Both the weights per unit area and the abrasion values were clearly improved as compared to the comparative tests, even if higher process temperatures were applied (Table 2).

TABLE 2

| Example No. | Process parameters: current density ($A/dm^2$) | Temperature (°C.) | Treatment time (sec) | Surface properties: Weight per unit area ($g/m^2$) | Abrasion ($g/m^2$) | Resistance to alkali (sec) |
|---|---|---|---|---|---|---|
| 1 | 4.5 | 80 | 90 | 1.80 | — | 105 |
| 2 | 4.5 | 60 | 150 | 3.22 | 0.10 | 135 |
| 3 | 1.0 | 40 | 500 | 2.56 | 0.52 | 95 |
| 4 | 1.0 | 80 | 90 | 1.36 | 0.75 | 70 |
| 5 | 3.0 | 80 | 90 | 1.60 | 0.65 | 120 |
| 6 | 3.0 | 60 | 150 | 1.86 | 0.20 | 115 |
| 7 | 4.5 | 50 | 150 | 3.50 | 0.15 | 120 |
| 8 | 4.5 | 60 | 150 | 3.20 | 0.12 | 125 |
| 9 | 2.2 | 50 | 300 | 2.80 | 0.08 | 110 |

COMPARATIVE EXAMPLES C9 TO C14

The process was the same as in Comparative Examples C1 to C8, except that, in accordance with the teaching of U.S. Pat. No. 4,229,266, an aqueous electrolyte containing 50 g/l of $H_2SO_4$, 25 g/l of $H_3PO_4$ and 12 g/l of $Al^{+3}$ ions (corresponding to a content of 148 g/l of $A_2(SO_4)_3.18H_2O$) was used. Table 3 shows that the alkali resistance values were clearly below those of the oxide layers produced in accordance with this invention.

TABLE 3

| Example No. | Process parameters: current density ($A/dm^2$) | Temperature (°C.) | Treatment time (sec) | Surface properties: Weight per unit area ($g/m^2$) | Abrasion ($g/m^2$) | Resistance to alkali (sec) |
|---|---|---|---|---|---|---|
| C9 | 8 | 35 | 25 | 2.8 | 0.15 | 36 |
| C10 | 8 | 35 | 25 | 3.1 | 0.20 | 38 |
| C11 | 12 | 55 | 25 | 3.4 | 0.18 | 31 |
| C12 | 11 | 40 | 25 | 2.5 | 0.32 | 31 |
| C13 | 6 | 40 | 30 | 2.7 | 0.33 | 41 |
| C14 | 12 | 55 | 30 | 3.1 | 0.15 | 34 |

EXAMPLE 10

An aluminum substrate prepared in accordance with Example 9 was coated with a negative-working photosensitive layer of the following composition:

0.70 p.b.w. of the polycondensation product of 1 mole of 3-methoxy-diphenylamine-4-diazonium sulfate and 1 mole of 4,4'-bis-methoxymethyl-diphenyl ether, precipitated as the mesitylene sulfonate,
3.40 p.b.w. of 85% strength phosphoric acid,
3.00 p.b.w. of a modified epoxide resin, obtained by reacting 50 parts by weight of an epoxide resin having a molecular weight of less than 1,000 and 12.8 parts by weight of benzoic acid in ethylene glycol monomethyl ether, in the presence of benzyltrimethyl-ammonium hydroxide,
0.44 p.b.w. of finely-ground Heliogen Blue G (C.I. 74,100),
62.00 p.b.v. of ethylene glycol monomethyl ether,
30.60 p.b.v. of tetrahydrofuran, and
8.00 p.b.v. of butyl acetate.

After exposure through a negative mask, development was performed with a solution of:

2.80 p.b.w. of $Na_2SO_4.10H_2O$,
2.80 p.b.w. of $MgSO_4.7H_2O$,
0.90 p.b.w. of 85% strength phosphoric acid
0.08 p.b.w. of phosphorous acid,
1.60 p.b.w. of an anionic surfactant,
10.00 p.b.w. of benzyl alcohol,
20.00 p.b.w. of n-propanol, and
60.00 p.b.w. of water.

The printing plate produced in this way was developed rapidly and without staining. 150,000 prints could be run with the resulting printing form. A support material prepared in accordance with Comparative Example C9 and coated with the same composition was developed only with difficulty. After development, yellow staining was likely to remain in the non-image areas, which was possibly caused by adhering particles of the diazonium compound. A support material according to Comparative Example C3 was also used, and gloss was stated in the non-image areas during printing, after about 90,000 prints, which became stronger and stronger with increasing numbers of prints. After 100,000 prints the copy quality was reduced to an industrially unacceptable degree.

EXAMPLE 11

An aluminum substrate prepared in accordance with Example 8 was coated with the following positive-working photosensitive solution:

6.00 p.b.w. of a cresol/formaldehyde novolak (softening range 105° to 120° C., according to DIN 53,181), 1.10 p.b.w. of the 4-(2-phenyl-prop-2-yl)phenyl ester of naphthoquinone-(1,2)-diazide-(2)-sulfonic acid-(4),
0.81 p.b.w. of polyvinyl butyral
0.75 p.b.w. of naphthoquinone-(1,2)-diazide-(2)-sulfonic acid chloride-(4)
0.08 p.b.w. of crystal violet, and
91.36 p.b.w. of a solvent mixture comprised of 4 p.b.v. of ethylene glycol monomethyl ether, 5 p.b.v. of tetrahydrofuran and 1 p.b.v. of butyl acetate.

The coated web was dried in a drying tunnel at temperatures up to 120° C. The printing plate produced in this way was exposed through a positive original and developed with a developer of the following composition:
5.30 p.b.w. of $Na_2SiO_3.9H_2O$
3.40 p.b.w. of $Na_3PO_4.12H_2O$
0.30 p.b.w. of $NaH_2PO_4$, anhydrous
91.00 p.b.w. of water The resulting printing form exhibited very good printing and processing behavior and showed excellent contrasts following exposure. The number of prints that could be run was 150,000.

Another plate, which had been prepared in the same way but using the support material according to Comparative Example C10, showed blue staining in the non-image areas. If the developer was allowed to act on the plate over a prolonged period, there resulted a pronounced light-dark coloration in the non-image areas, which was a sign for an attack of the oxide layer by the developer solution.

EXAMPLE 12

An aluminum substrate prepared in accordance with Example 9 was coated with the following negative-working layer:
16.75 p.b.w. of an 8.0% strength solution of the reaction product of a polyvinyl butyral having a molecular weight of about 70,000 to 80,000 and being composed of 71% by weight of vinyl butyral units, 2% by weight of vinyl acetate units and 27% by weight of vinyl alcohol units, with propylene sulfonyl isocyanate,
2.14 p.b.w. of 2,6-bis-(4-azido-benzene)-4-methyl cyclohexanone,
0.23 p.b.w. of ®Rhodamine 6 GDN extra, and
0.21 p.b.w. of 2-benzoyl-methylene-1-methyl-β-naphthothiazoline, in:
100.00 p.b.w. of ethylene glycol monomethyl ether and
50.00 p.b.w. of tetrahydrofuran.

The dry layer had a weight of 0.75 g/m$^2$. By means of a 5 kW metal halide lamp the reproduction layer was exposed through a negative original for 35 seconds. The exposed layer was treated, by means of a cotton pad, with a developer solution composed of:
5 p.b.w. of sodium lauryl sulfate,
1 p.b.w. of $Na_2SiO_3.5H_2O$ and
94. p.b.w. of water, whereby the non-image areas were removed.

In a printing machine, the plate gave 170,000 prints. When a support material prepared in accordance with Comparative Example C12 was employed, the adhesion of the reproduction layer was considerably reduced.

EXAMPLE 13

A support, which had been anodically oxidized as described in Example 7, was coated with the following solution, in order to produce an electrophotographic offset printing plate:
10.00 p.b.w. of 2,5-bis(4'-diethylaminophenyl)1,3,4-oxadiazole,
10.00 p.b.w. of a copolymer of styrene and maleic acid anhydride, having a softening point of 210° C.,
0.02 p.b.w. of ®Rhodamine FB (CI. 45,170), and
300.00 p.b.w. of ethylene glycol monomethyl ether.

By means of a corona, the layer was negatively charged to about 400 V in the dark. The charged plate was imagewise exposed in a reprographic camera and then developed with an electrophotographic suspension-type developer obtained by dispersing 3.0 p.b.w. of magnesium sulfate, in a solution of 7.5 p.b.w. of pentaerythritol resin ester, in 1,200 p.b.v. of an isoparafin mixture having a boiling range of 185° to 210° C. After removal of excess developer liquid, the developer was fixed and the plate was immersed, during 60 seconds, in a solution comprised of:
35 p.b.w. of $Na_2SiO_3.9H_2O$,
140 p.b.w. of glycerol,
550 p.b.w. of ethylene glycol, and
140 p.b.w. of ethanol.

Then, the plate was rinsed with a vigorous jet of water, whereby those areas of the photoconductor layer, which were not covered by toner, were removed. After rinsing, the printing form was ready for printing. The non-image areas of the plate showed a good hydrophilic character, and there were no signs of an attack due to the action of alkaline solutions. Several thousand good prints could be made from the printing form.

EXAMPLE 14

In an additional treatment step, an aluminum sheet prepared in accordance with Example 2 was immersed into a 0.2% strength aqueous solution of polyvinylphosphonic acid, at a temperature of 50° C. and for 20 seconds (additional hydrophilizing). After drying, the support material, which had been given additional hydrophilic properties by the described treatment, was processed according to Example 10, whereby the ink-repelling character of the non-image areas was found to be even further improved.

What is claimed is:

1. A process for anodic oxidation of material selected from aluminum and aluminum alloys, comprising the steps of:
roughening the surface of the material by mechanical, chemical or electrochemical means,
placing the material in an aqueous electrolyte free from $H_2SO_4$ and containing from about 25 to about 500 grams per liter of $H_3PO_4$ and at least 5 grams per liter of $Al^{+3}$ ions, said electrolyte being maintained at a temperature of from about 35° C. to about 95° C., and
anodically oxidizing the material at a current density of from about 1 A/dm$^2$ to about 30 A/dm$^2$ for a period of from about 5 to about 500 seconds, forming thereby an aluminum oxide layer on the surface of said material.

2. A process as claimed in claim 1, wherein said electrolyte contains from about 50 to about 150 grams per liter $H_3PO_4$ and from about 10 to about 20 grams per liter of $Al^{+3}$ ions, and wherein said anodic oxidation is carried out at a temperature of from about 40° C. to about 75° C., at a current density of from about 2 A/dm$^2$ to about 20 A/dm$^2$ and for a period of from about 10 to about 300 seconds.

3. A process as claimed in claim 1, wherein said electrolyte contains from about 5 to about 15 parts by weight $H_3PO_4$ per 1 part by weight $Al^{+3}$ ions.

4. A process as claimed in claim 1, wherein said electrolyte contains a salt of aluminum having a phosphoroxo anion as a source of $Al^{+3}$ ions.

5. A process as claimed in claim 4, wherein said electrolyte contains $AlPO_4$.

6. A process as claimed in claim 1, wherein said material is in the form of a plate, sheet or web.

7. A process as claimed in claim 1, wherein said process includes the steps of hydrophilizing the aluminum oxide layer by chemical or electrochemical means.

8. A support for an offset printing plate, comprising an anodically oxidized sheet of aluminum or aluminum alloy produced by the process as defined by claim 1 and having an oxide layer thereon.

9. A support as claimed in claim 8, wherein said oxide layer has a thickness corresponding to a weight per unit area of at least about 1.36 $g/m^2$ and an alkali resistance of at least about 70 sec. according to the zincate test.

10. A support as claimed in claim 9, wherein said oxide layer has a high relative abrasion resistance.

11. A process for producing an offset printing plate, comprising:

roughening a surface of an aluminum or aluminum alloy sheet;

placing the sheet in an aqueous electrolyte free from $H_2SO_4$ and containing from about 25 to about 500 grams per liter of $H_3PO_4$ and at least 5 grams per liter of $Al^{+3}$ ions, said electrolyte being maintained at a temperature of from about 35° C. to about 95° C.; and anodically oxidizing the sheet at a current density of from about 1 $A/dm^2$ to about 30 $A/dm^2$ for a period of from about 5 to about 500 seconds, forming thereby an aluminum oxide layer on said surface; and coating said aluminum oxide layer with a photosensitive layer.

12. A process as claimed in claim 11, wherein said photosensitive layer, after exposure, yields a surface in imagewise configuration useful in offset printing.

13. A process as claimed in claim 11, wherein said photosensitive layer comprises a positive-working reproduction layer or a negative-working reproduction layer.

14. A support material for offset printing plates comprising:

a substrate of aluminum or aluminum alloy having an aluminum oxide layer produced by anodic oxidation in an electrolyte consisting essentially of an aqueous solution of $H_3PO_4$ and $Al^{+3}$ ions; and a photosensitive layer coated over said aluminum oxide layer;

wherein said photosensitive layer, after exposure, yields a surface in imagewise configuration useful in printing.

15. A support material as claimed in claim 14, wherein said support material further includes one or more electrophotographic layers containing an inorganic or organic photoconductor.

* * * * *